United States Patent [19]

Iwama et al.

[11] Patent Number: 4,718,482

[45] Date of Patent: Jan. 12, 1988

[54] METHOD FOR MANUFACTURING HEAT EXCHANGE VEHICLE

[75] Inventors: Tetsuji Iwama; Katashi Katsumata; Hajime Kudo; Yo Takeuchi, all of Susonoshi, Japan

[73] Assignee: Mitsubishi Aluminum Kabushiki Kaisha, Tokyo, Japan

[21] Appl. No.: 897,873

[22] Filed: Aug. 19, 1986

[30] Foreign Application Priority Data

Oct. 7, 1985 [JP] Japan ..... 60-221859

[51] Int. Cl.[4] ..... F28F 13/18

[52] U.S. Cl. ..... 165/133; 148/6.15 R; 148/6.27; 148/11.5 A

[58] Field of Search ..... 165/134.1, 133; 148/11.5 A, 13.1, 6.15 R, 6.27

[56] References Cited

U.S. PATENT DOCUMENTS 3,400,023 9/1968 McDonald ..... 148/6.27
3,425,876 2/1969 Steinbrecher ..... 148/6.27
3,900,370 8/1975 Germscheid et al. ..... 148/6.15 R
4,225,350 9/1980 Allan et al. ..... 148/6.27

OTHER PUBLICATIONS

Douty, A., and Spruance, F. P., "Amorphous Phosphate Coatings for Protection of Aluminum Alloys and for Paint Adhesion," (undated).

*Primary Examiner*—Christopher W. Brody
*Assistant Examiner*—George Wyszomierski
*Attorney, Agent, or Firm*—Wyatt, Gerber, Shoup, Scobey and Badie

[57] ABSTRACT

A method for manufacturing a novel heat exchanging vehicle comprising the steps of forming an inorganic surface layer over a cold rolled, aluminum or aluminum alloy sheet; treating the inorganic surface layer with a phosphoric compound solution; annealing the sheet; and forming the sheet into a predetermined shape. The resulting heat exchanging vehicle such as a fin has a good wettability and a high corrosion resistance to white rust based on the uniformity of the said surface layer.

36 Claims, No Drawings

METHOD FOR MANUFACTURING HEAT EXCHANGE VEHICLE

BACKGROUND OF THE INVENTION

The present invention relates to a novel method for manufacturing a heat exchanging vehicle made of aluminum or an aluminum alloy, such as a heat exchanging fin, for use in an automobile or a home air conditioner, etc.

A heat exchanging fin made of aluminum or an aluminum alloy (hereinafter referred to simply as "aluminum") is generally manufactured, for instance, by forming a surface layer of organic or inorganic materials or composite materials mentioned above having good wettability over an aluminum sheet, pressing the aluminum sheet provided with such a hydrophilic surface layer to form a fin, and removing the lubricating oil such as a pressing oil attached to the fin surface during the pressing operation with a neutral or weak alkaline detergent aqueous solution, or by other means.

Recently, the fin pitch in heat exchanging units has been reduced for the improvement of heat exchanging efficiency and the miniaturization of heat exchangers. In an evaporator, such a reduced fin pitch causes the condensation of atmospheric moisture on fins, increasing resistance to an air stream, generating noises and blowing condensed water into a room. Further, it necessitates more energy for defrosting outdoors in winter time. As a result, it is extremely important that the fin surface have good wettability and high resistance to oil stain.

In addition, the fins should have a good corrosion resistance to white rust to prevent the formation of such a product which easily peels off.

To deal with these problems, the inventors have previously proposed a method for manufacturing a heat exchanging vehicle by forming a surface oxide layer with a weight of about 0.2–1.0 g/m$^2$ over an aluminum sheet and forming it into a desired shape (Japanese Patent Laid-Open No. 58-106396). This proposal, however, is not completes satisfactory.

It has been found that when a precoated sheet is formed into a fin by pressing, degreased with an organic solvent such as a trichloroethylene to remove a lubricating oil which is attached during the pressing operation from a fin surface, and then assembled into an evaporator, the fin surface does not always have good wettability and high resistance to oil stain, depending upon degreasing conditions such as degreasing bath temperature and oil concentration in the degreasing bath, and the conditions of an inorganic surface layer such as an anodic oxidation layer and a hydrated layer, etc.

A fin sheet is usually obtained by annealing a so-called H1n-temper sheet of a predetermined thickness manufactured by cold rolling to a so-called H2n- or O-temper sheet having the desired mechanical properties.

Therefore, oil components remain on the aluminum sheet surface without being evaporated during annealing. These components become scorched, adhere to the surface and make it rough even after the formation of an hydrated surface layer. As a result, good wettability and high corrosion resistance to white rust are not necessarily obtained.

OBJECT AND SUMMARY OF THE INVENTION

An object of the present invention is, therefore, to provide a method for manufacturing a novel heat exchanging vehicle having good wettability and high corrosion resistance to white rust.

Another object of the present invention is to provide a method for manufacturing a heat exchanging vehicle which may be easily formed.

In view of the above objects, the inventors have carried out extensive research. As a result, they have found that a heat exchanging vehicle having good wettability and high corrosion resistance to white rust can be obtained by forming an inorganic surface layer over a cold-rolled aluminum sheet such as an H1n-temper sheet, wherein n is, for instance, 2, 4, 6 or 8, by treating the inorganic surface layer with an aqueous solution containing a phosphoric compound to spread the phosphoric compound over surrface layer, annealing the aluminum sheet to convert it to an H2n- or O-temper sheet having the desired mechanical properties wherein n is, for instance, 2, 4, 6 or 8, and then forming it into a desired shape. Such a heat exchanging vehicle has good and uniform wettability regardless of degreasing conditions and corrosion resistance to white rust. This method is efficient, easy and provides a high yield.

DESCRIPTION OF THE PREFERRED EMBODIMENTS

The inorganic surface layer formed over an H1n-temper sheet according to the present invention may be an anodic oxidation surface layer or a hydrated surface layer such as a boehmite surface layer formed by immersing in a boiling pure water, a boehmite surface layer treated with a basic aqueous solution at pH 9–12 adjusted with triethanolamine, ammonia water and sodium hydroxide, etc., a surface layer formed by the treatment at a basic aqueous solution of pH 9–12 treated with oxidants such as $XO^-$, $XO_2^-$, $XO_3^-$ (X being halogen), peroxyborate disclosed in Japanese Patent Laid-Open No. 59-211578, a silicate compound surface layer formed over the said anodic oxidation layer, the said hydrated layer, a chromate layer, or a silicate compound surface layer alone. These inorganic surface layers having a good wettability are finely porous, having a pore size of about 100–500 Å in the anodic oxidation surface layers, about 500–2000 Å in the hydrated surface layers, and about 3000–10000 Å in the silicate surface layers. Such a surface layer may have a weight of about 0.2–1.0 g/m$^2$, more preferably about 0.4–0.8 g/m$^2$.

Among those inorganic surface layers, a hydrated surface layer or a hydrated surface layer covered with a extremely thin silicated layer after hydration are particularly preferred because their surface conditions and porosity permit the phosphoric compound to adhere uniformly thereto.

The phosphoric compound on the inorganic surface layer may be easily formed by treating the surface layer with an aqueous solution containing the phosphoric compound and drying it. For instance, it may be easily formed by dissolving the phosphoric compound in deionized water, tap water or an industrial water at a concentration of 50 ppm or more, but more preferably at a lower concentration of about 1–20 ppm, adjusting the phosphoric compound aqueous solution to have pH of 2–12, preferably 6–8, and subjecting the surface layer to immersion or showering with the phosphoric compound aqueous solution at temperature of 10°–100° C., for one second to 10 minutes, preferably 5–20 seconds. The pH adjustment of this solution may be conveniently achieved using phosphoric acid, citric acid, tartaric acid, acetic acid, sulfuric acid, sodium hydroxide, potassium hydroxide, calcium hydroxide, triethanolamine, ammonia water and the like. The adjusting agent will be selected on the basis of the phosphoric compound employed. The phosphoric compound is defined on the inorganic surface layer at a preferred density of about 0.005–0.15 g/m$^2$ calculated on the basis of phosphorus.

The phosphoric compounds which may be used alone or in combination in the present invention include inorganic phosphoric compounds such as hypophosphite, orthophosphite, metaphosphite, hypophosphate, orthophosphate, metaphosphate, monoperoxyphosphate, peroxydiphosphate, tripolyphosphate, tetrapolyphosphate, pyrophosphate, etc., inorganic phosphate esters such as myo-inositol diphosphate, myo-inositol triphosphate, myo-inositol tetraphosphate, myo-inositol pentaphosphate, myo-inositol hexaphosphate, etc., water-soluble salts of the above inorganic phosphate esters in which hydrogen of the combined phosphates is substituted with Na, K, Li, Mg, Ca, etc., phosphonic compounds such as 1-hydroxypropane-1,1-diphosphonic acid; 1-hydroxy-1-phenylmethane-1,1-diphosphonic acid; 1-hydroxyethane-1,1-diphosphonic acid; 1-aminoethane-1,1-diphosphonic acid; dimethylaminobutane-1,1-diphosphonic acid; aminotrimethylene phosphonic acid; ethylenediaminetetramethylene phosphonic acid; phosphonic succinic acid; 1-phosphone-1-methylsuccinic acid; etc., and water-soluble salts of these phosphonic compounds with sodium, potassium, ammonium, alkanolamine, etc.

In the treatment with a phosphoric compounds aqueous solution, nonionic surfactants are preferably added in a small amount, e.g. about 0.1–2%. The inclusion of the nonionic surfactant together with the phosphoric compound in the inorganic surface layer makes it easier to conduct the press-forming operations which is carried out after annealing.

The nonionic surfactants which may be used alone or in combination in the present invention may include polyoxyethylenealkylallyl ether type (polyoxyethylenenonyl-phenyl ether, polyoxyethyleneoctylphenyl ether), alkyl ether type (polyoxyethylenelauryl ether), alkyl ester type (polyoxyethylene oleate), alkylamine type (polyoxyethylenelaurylamine), ester type of sorbitan derivatives (sorbitan laurate, sorbitan palmitate), sorbitan derivatives compound type (polyoxyethylenesorbitanlaurate polyoxyethylenesorbitanstearate), etc.

The cold rolled H1n-temper sheet formed with the inorganic surface layer including the phosphoric compound (and preferably containing the nonionic surfactant) is annealed at 200°–450° C. for 1 second–20 hours in a batch process or a continuous process, preferably at 200°–360° C. for 3–20 hours in a batch process to provide an H2n- or O-temper sheet having the desired properties.

In this process, it is to be noted that the aluminum sheet is subjected to a surface treatment just after cold rolling. Therefore, the problem encountered in the conventional method in which oil components sticking on the sheet surface are scorched can be avoided. The appearance of the formed sheet is uniform. Thus, the H2n- or O-temper sheet with a surface having good wettability and a high corrosion resistance to white rust is obtained.

The H2n- or O-temper sheet formed with such a surface layer having good wettability and high corrosion resistance to white rust is then subjected to forming such as drawless-pressing or draw-pressing. Lubricating oil such as pressing oil remaining on the sheet surface after the press forming may be removed by a neutral or weak-alkaline aqueous solution or an organic solvent such as trichloroethylene to provide the desired fins.

Since the heat exchanging vehicle thus obtained has an inorganic surface layer including the phosphoric compound, fine pores of the inorganic surface layer have been modified, so that the surface layer tends to prevent the adsorption of pressing oil. Thus, the inorganic surface layer retains its good original wettability. Further, it has an improved corrosion resistance to white rust even after annealing. This surface layer makes it unnecessary to carry out the troublesome process for removing the pressing oil. Further, a high productivity is ensured.

The present invention will be explained in further detail by the following Examples.

EXAMPLE 1

An aluminum sheet of H18-temper (JIS1200) having a 800-mm width, a 8000-m length and a 0.115-mm thickness was degreased with weak alkaline aqueous solution, and immersed in an aqueous solution of sodium hypochlorite (NaOCl concentration: 2000 ppm, pH 10.5) at about 85° C. to form a hydrated surface layer of about 0.6 g/m$^2$ thickness having a pore size of about 500–1000 Å.

Next, it was immersed in a 1.5%-water glass aqueous solution (pH 11.4) at about 60° C., washed with water shower, and then formed with an extremely thin silicate surface layer having a thickness of about 0.025 g/m$^2$ based on silicon.

An aqueous solution of 2% sodium tripolyphosphate and 0.5%-polyoxyethylene nonylphenylether (HLB value 14) was applied over the sheet at 25°–30° C., and it was dried with hot air at 150° C. for 10 seconds. Thus, the inorganic phosphate at a weight of about 0.015 g/m$^2$ based on phosphorus and 0.008 g/m$^2$ of the nonionic surfactant were included over the hydrated surface layer treated with water glass aqueous solution.

The sheet was annealed in a furnace at 260° C. to convert it to an H26-temper sheet.

The H26-temper sheet was subjected to drawless-pressing to form fins, and then immersed in trichloroethylene heated at about 80° C. for one minute to remove any remaining oil. It was then assembled into a heat exchanger.

EXAMPLE 2

Instead of treatment with sodium tripolyphosphate and polyoxy ethylene nonylphenylether as in Example 1, an immersion treatment was carried out with an aqueous solution of 5% 1-hydroxy ethane-1,1-diphosphonic acid, 5%-5Na salt of aminotrimethylene phosphonic acid and 1% polyoxyethylene oleate at 50° C. A similar drying operation with hot air was performed to include the phosphonic compound at a weight of 0.08 g/m$^2$ based on phosphorus and 0.02 g/m$^2$ of the nonionic surfactant over the hydrated surface layer treated with water glass aqueous solution.

The same annealing was carried out for the sheet as in Example 1, converting it to an H26-temper sheet, which was then subjected to a drawless-pressing to provide fins. The fins were degreased with trichloroethylene (immersion at 50° C., 30° C. and 70° C. each for one minute). They were then assembled into a heat exchanger.

EXAMPLE 3

The same aluminum sheet as in Example 1 was degreased with a weak alkaline aqueous solution, washed with water and then dried. It was then immersed in an aqueous solution of 0.5%-triethanolamine at 90° C. for 60 seconds to perform a boehmite treatment to form a hydrated inorganic surface layer having a weight of 0.4 $g/m^2$, a pore size of about 800–2000 Å and good wettability. It was then treated with an aqueous solution of 2% myo-inositol hexaphosphoric acid ester and 0.5% polyoxyethylene sorbitan laurate (HLB value 15.4) at 25°–30° C. It was dried with hot air at 150° C. for 10 seconds to form a surface layer of the phosphate ester with myo-inositol at a weight of 0.03 $g/m^2$ based on phosphorus and 0.015 $g/m^2$ of the nonionic surfactant over the hydrated surface layer.

It was then annealed in a non-oxidative furnace at 300° C. for 8 hours to convert it to a O-temper sheet.

Draw-pressing was then performed to form fins, which were degreased as in Example 2. The fins were finally assembled into a heat exchanger.

EXAMPLE 4

The same aluminum sheet as in Example 1 was subjected to anodic oxidation in an aqueous solution of 15% sulfuric acid to form a porous anodic oxidation surface layer having a weight of 0.6 $g/m^2$ and pore size of 100–150 Å. It was treated with a solution containing the same phosphoric compound and the same nonionic surfactant as in Example 1, so that the anodic-oxidation surface layer included the inorganic phosphate at a weight of 0.015 $g/m^2$ based on phosphorus and 0.008 $g/m^2$ of the nonionic surfactant. The same annealing was then conducted and the same drawless-pressing was carried out to form fins. They were further degreased as in Example 2 and assembled into a heat exchanger.

EXAMPLE 5

The same aluminum sheet as in Example 1 was immersed in an aqueous solution of sodium silicate ($SiO_2/Na_2O=5$, $SiO_2$ concentration=55 g/l) at 60° C. for one minute, and dried at 200° C. for 60 seconds to form a silicate surface layer having a weight of 0.8 $g/m^2$ and a pore size of about 3000–5000 Å. It was then treated with a solution containing the same phosphoric compound and the same nonionic surfactant as in Example 1 to deposit an inorganic phosphate layer weighing about 0.015 $g/m^2$ based on phosphorus and 0.008 $g/m^2$ of the nonionic surfactant. The same annealing was conducted. Thereafter, the sheet was subjected to drawless-pressing to form fins, which were degreased and assembled into a heat exchanger.

Comparative Examples 1–5

The same treatments as in Examples 1–5 were performed except for omitting the treatment with the aqueous solution containing phosphoric compounds and nonionic surfactants.

Comparative Example 6

The same treatments as in Example 1 were performed except for omitting the treatment of forming the inorganic surface layer.

Comparative Example 7

The same aluminum sheet as in Example 1 was annealed to provide an H26-temper sheet, which was then subjected to the same surface treatment as in Example 1 and drawless-pressing to form fins. It was degreased and then assembled into a heat exchanger.

Properties

With respect to the aluminum heat exchanger fins obtained as mentioned above, uniformity of surface layers, wettability (contact angle for water drop) after assembly into heat exchangers and degreasing, formability and corrosion resistance to white rust after cycle test of drying and wetting for 5 days (7 hour a day in a wet condensed condition by cooling the fins) in an atmosphere of 40° C., 85% RH were investigated. The results are shown in the following table.

TABLE

| | Uniformity of Surface Layer | Contact Angle (°) | Formability | Corrosion Resistance to White Rust |
|---|---|---|---|---|
| Example 1 | Uniform | 10 | No crack and No punch-out | No White Rust |
| Example 2 | " | " | No crack and No punch-out | No White Rust |
| Example 3 | " | " | No crack and No punch-out | No White Rust |
| Example 4 | " | " | No crack and No punch-out | No White Rust |
| Example 5 | " | " | No crack and No punch-out | No White Rust |
| Comparative Example 1 | " | 40 | A Few Cracks | Entirely Covered with White Rust |
| Comparative Example 2 | " | 45 | " | Entirely Covered with White Rust |
| Comparative Example 3 | " | 60 | " | Entirely Covered with White Rust |
| Comparative Example 4 | " | 50 | " | Entirely Covered with White Rust |
| Comparative Example 5 | " | 40 | " | Entirely Covered with White Rust |
| Comparative Example 6 | — | 55 | " | Little White Rust |
| Comparative Example 7 | Uneven | 40 | No crack and No punch-out | Little White Rust |

As is apparent from the above, the fins according to the present invention are superior to those of the comparative examples with respect to surface layer uniformity, water contact angle (wettability), formability and corrosion resistance to white rust. Thus, fins having a good heat exchanging efficicency and durability are obtained at a high yield.

What is claimed is:

1. A method for manufacturing a heat exchanging vehicle, comprising the steps of:
(a) forming an inorganic surface layer over a cold-rolled sheet of aluminum or an aluminum alloy;
(b) treating said inorganic surface layer with an aqueous solution containing a phosphoric compound to deposit said phosphoric compound on said inorganic surface layer;
(c) annealing said sheet; and
(d) forming said sheet into a heat exchanging vehicle.

2. The method according to claim 1, wherein said cold-rolled sheet of aluminum or an aluminum alloy is an H1n-temper sheet wherein n represents 2, 4, 6 or 8.

3. The method according to claim 1, wherein said inorganic surface layer has a weight of about 0.2 to 1.0 $g/m^2$.

4. The method according to claim 1, wherein said inorganic surface layer is covered with silicate compounds.

5. The method according to claim 1, wherein said inorganic surface layer is a hydrated surface layer.

6. The method according to claim 5, wherein said hydrated inorganic surface layer is covered with an extremely thin silicate layer.

7. The method according to claim 1, wherein said inorganic surface layer is an anodic-oxidation surface layer.

8. The method according to claim 7, wherein said anodic-oxidation inorganic surface layer having a good wettability is covered with an extremely thin silicate layer.

9. The method according to claim 1, wherein said phosphoric compound is selected from the group consisting of inorganic phosphoric, compounds inorganic phosphate esters, water-soluble salts of said inorganic phosphate esters, phosphonic acid compounds, water-soluble salts of said phosphonic acid compounds, and mixture thereof.

10. The method according to claim 1 wherein the weight of said inorganic surface layer is about 0.005 to 0.15 $g/m^2$ based on phosphorus.

11. The method according to claim 1, wherein said phosphoric compound aqueous solution contains at least 50 ppm of said phosphoric compound.

12. The method according to claim 1, wherein said solution containing said phosphoric compound additionally contains a nonionic surfactant.

13. The method according to claim 12, wherein the concentration of said nonionic surfactant is about 0.1 to 2%.

14. The method according to claim 1, wherein annealing is conducted at about 200° to 450° C. from 1 second to 20 hours.

15. The method according to claim 1, wherein said organic surface layer has a weight of 0.4 to 0.8 $g/m^2$.

16. The method according to claim 1, wherein said phosphoric compound solution contains 1 to 20 ppm of said phosphoric compound.

17. The method according to claim 1, wherein annealing is conducted at 200° to 260° C. for 3 to 20 hours.

18. The method according to claim 1, wherein said aluminum or aluminum alloy sheet is an H2n- or O-temper sheet wherein n is 2, 4, 6 or 8.

19. A heat exchanging vehicle formed by the steps comprising:
(a) forming an inorganic surface layer over a cold-rolled sheet of aluminum or an aluminum alloy;
(b) treating said inorganic surface layer with an aqueous solution containing a phosphoric compound to deposit said phosphoric compound on said inorganic surface layer;
(c) annealing said sheet; and
(d) forming said sheet into a heat exchanging vehicle.

20. The vehicle according to claim 19, wherein said cold-rolled sheet of an aluminum or an aluminum alloy is an H1n-temper sheet wherein n represents 2, 4, 6 or 8.

21. The vehicle according to claim 20, wherein said solution containing said phosphoric compound additionally contains a nonionic surfactant.

22. The vehicle according to claim 21, wherein said nonionic surfactant is at a concentration of about 0.1 to 2%.

23. The vehicle according to claim 19, wherein said inorganic surface layer has a weight of about 0.2 to 1.0 $g/m^2$.

24. The vehicle according to claim 19, wherein said inorganic surface layer is covered with silicate compounds.

25. The vehicle according to claim 19, wherein said inorganic surface layer is a hydrated surface layer.

26. The vehicle according to claim 25, wherein said hydrated inorganic surface layer is covered with an extremely thin silicate layer.

27. The vehicle according to claim 15, wherein said inorganic surface layer is an anodic-oxidation surface layer.

28. The vehicle according to claim 27, wherein said anodic-oxidation inorganic surface layer is covered with an extremely thin silicate layer.

29. The vehicle according to claim 17, wherein said phosphoric compound is selected from the group consisting of inorganic phosphoric compounds, inorganic phosphate esters, water-soluble salts of said inorgranic phosphate esters, phosphonic acid compounds and water-soluble salts of said phosphonic acid compounds and mixtures thereof.

30. The vehicle according to claim 19, wherein the weight of said inorganic surface layer is about 0.005 to 0.15 $g/m^2$ based on phosphorus.

31. The vehicle according to claim 19, wherein said phosphoric compound aqueous solution contains at least 50 ppm of said phosphoric compound.

32. The vehicle according to claim 19, wherein said annealing is carried out at about 200° to 450° C. for 1 second to 20 hours.

33. The vehicle according to claim 19, wherein said aluminum or aluminum alloy sheet after annealing is an H2n- or O-temper sheet wherein n is 2, 4, 6 or 8.

34. The vehicle according to claim 19, wherein said organic surface layer has a weight of 0.4 to 0.8 $g/m^2$.

35. The vehicle according to claim 19, wherein said phosphoric compound aqueous solution contains 1 to 20 ppm of said phosphoric compound.

36. The vehicle according to claim 19, wherein said annealing is conducted at 200° to 360° C. for 3 to 20 hours.

* * * * *